US010837226B2

(12) United States Patent
Jeffries

(10) Patent No.: US 10,837,226 B2
(45) Date of Patent: Nov. 17, 2020

(54) FRAME WITH STRENGTHENED CORNERS

(71) Applicant: Austin Hardware & Supply, Inc., Lee's Summit, MO (US)

(72) Inventor: Mark Steven Jeffries, Buford, GA (US)

(73) Assignee: Austin Hardware & Supply, Inc., Lee's Summit, MO (US)

( * ) Notice: Subject to any disclaimer, the term of this patent is extended or adjusted under 35 U.S.C. 154(b) by 0 days.

(21) Appl. No.: 15/699,395

(22) Filed: Sep. 8, 2017

(65) Prior Publication Data

US 2018/0073293 A1 Mar. 15, 2018

Related U.S. Application Data

(60) Provisional application No. 62/393,462, filed on Sep. 12, 2016.

(51) Int. Cl.
*E06B 3/98* (2006.01)
*E06B 3/964* (2006.01)
*E06B 3/96* (2006.01)

(52) U.S. Cl.
CPC ..... *E06B 3/982* (2013.01); *E06B 3/962* (2013.01); *E06B 3/9624* (2013.01); *E06B 3/9644* (2013.01)

(58) Field of Classification Search
CPC ..... E06B 3/982; E06B 3/962; E06B 3/9644; E06B 3/9624
USPC ..... 52/204.1
See application file for complete search history.

(56) References Cited

U.S. PATENT DOCUMENTS 4,124,322 A * 11/1978 Parisien ..... E06B 3/9648 160/381
4,195,681 A * 4/1980 Douglas ..... E06B 9/52 160/371
4,205,486 A * 6/1980 Guarnacci ..... E06B 3/205 49/501
4,569,154 A * 2/1986 Bayer ..... E05D 15/0604 49/161
5,595,426 A * 1/1997 Wolff ..... A47B 47/0033 16/390
5,666,773 A * 9/1997 Librande ..... B29C 65/2015 160/369
6,067,754 A * 5/2000 Bellart ..... E05D 15/0686 49/453
6,966,158 B1 * 11/2005 Christensen ..... E06B 3/22 49/504
6,991,693 B2 * 1/2006 Wylie ..... E06B 9/52 156/160

(Continued)

*Primary Examiner* — Patrick J Maestri
*Assistant Examiner* — Joseph J. Sadlon
(74) *Attorney, Agent, or Firm* — Polsinelli PC

(57) ABSTRACT

A frame assembly with strengthened corners is described. The frame assembly includes internal corner sets that squeeze or pull mitered or angled edges of frame sections together. The corner sets fit into openings at corners between adjacent frame sections. The frame assembly includes corner braces that snap lock over a corner between adjacent frame sections. The corner braces fit over exterior surfaces of the frame sections forming the frame assembly. The corner brace snaps into grooves in the exterior surfaces of the frame sections. The frame assembly includes a corner member that engages to an outer flange of joining frame sections. The corner member spans the corner between the joining frame sections.

21 Claims, 8 Drawing Sheets

(56) References Cited

U.S. PATENT DOCUMENTS

| | | | | |
|---|---|---|---|---|
| 9,238,934 | B2 * | 1/2016 | Booi | E06B 1/52 |
| 9,359,806 | B2 * | 6/2016 | Header | E06B 1/524 |
| 9,506,247 | B2 * | 11/2016 | Feldpausch | E04B 2/745 |
| 9,518,423 | B2 * | 12/2016 | Seuberling | E06B 9/52 |
| 9,593,526 | B2 * | 3/2017 | Wang Chen | E06B 3/5892 |
| 9,598,854 | B2 * | 3/2017 | Ter-Borch | E04B 1/40 |
| 9,869,122 | B2 * | 1/2018 | Isaacs | F24B 1/192 |
| 10,626,664 | B1 * | 4/2020 | Kelley | E06B 1/6007 |
| 2005/0235596 | A1 * | 10/2005 | Pegorado | E06B 3/9642 52/656.9 |
| 2008/0245001 | A1 * | 10/2008 | Alkoury | E06B 3/302 52/204.5 |
| 2014/0102017 | A1 * | 4/2014 | B001; Arie | E06B 1/52 52/204.1 |

* cited by examiner

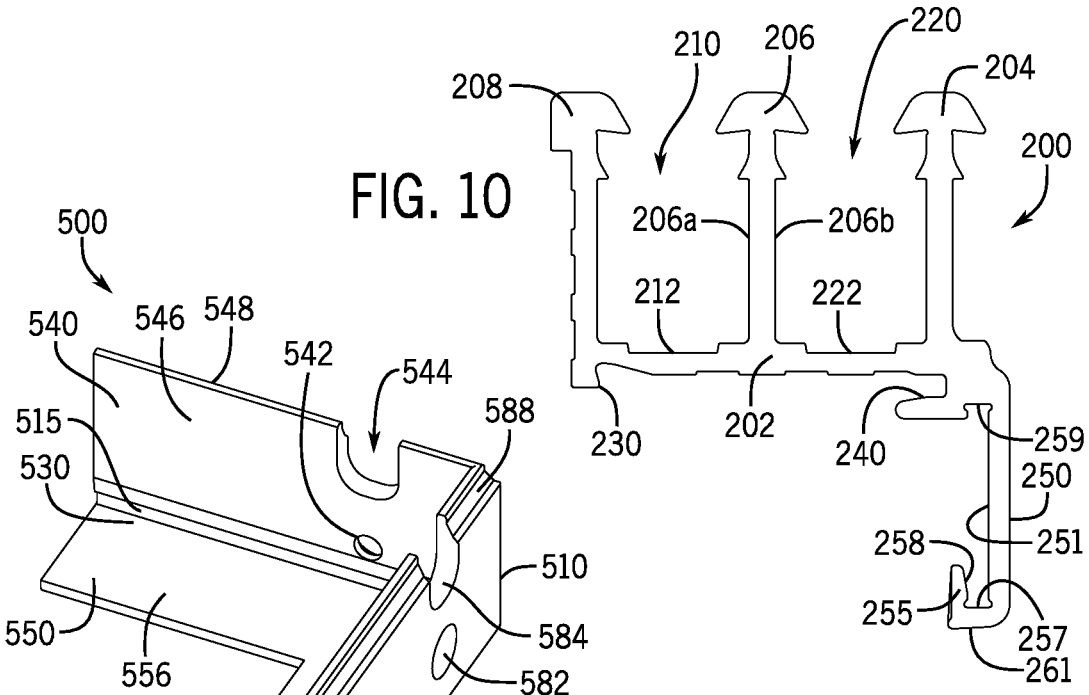
FIG. 10
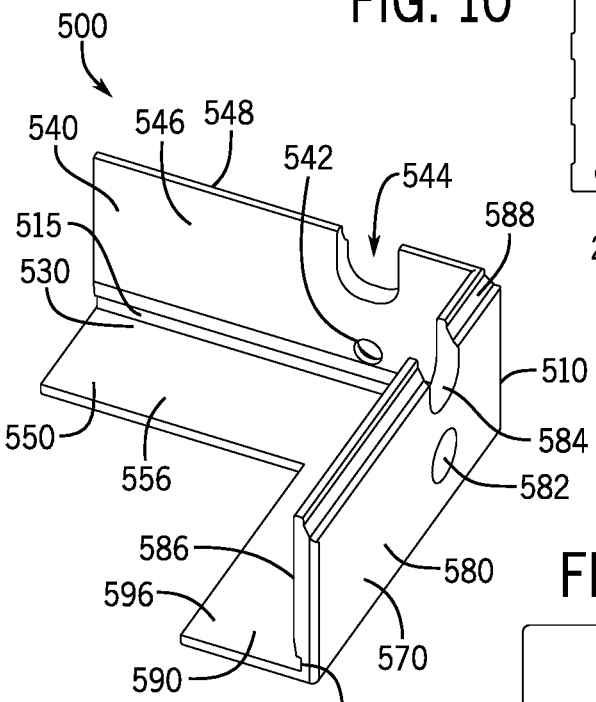
FIG. 11
FIG. 12
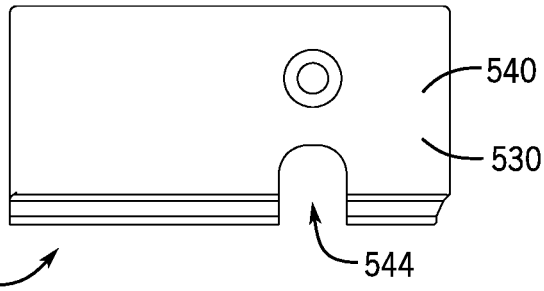
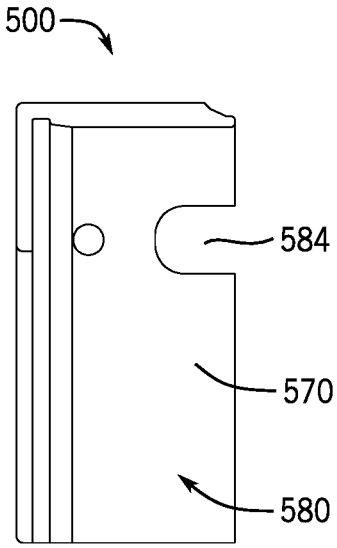
FIG. 13
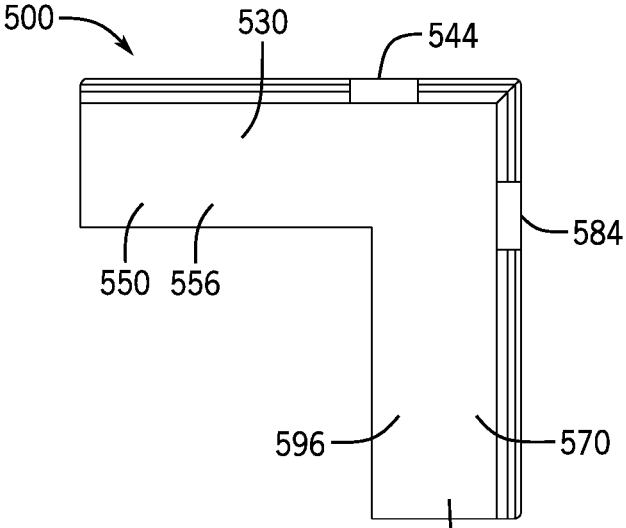
FIG. 14

FIG. 15
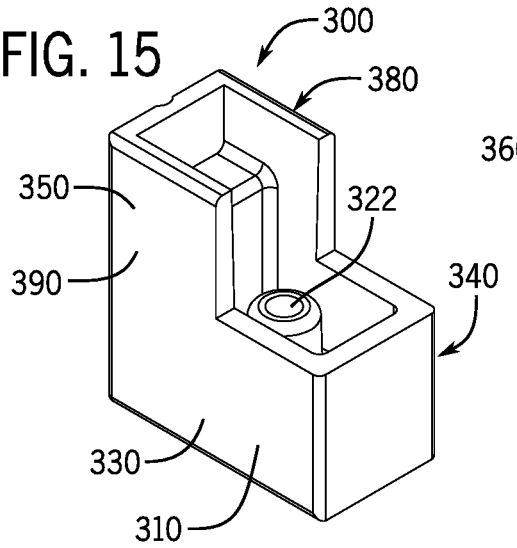
FIG. 16
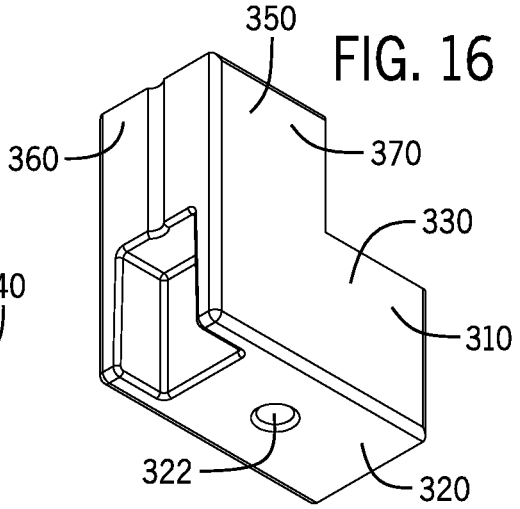
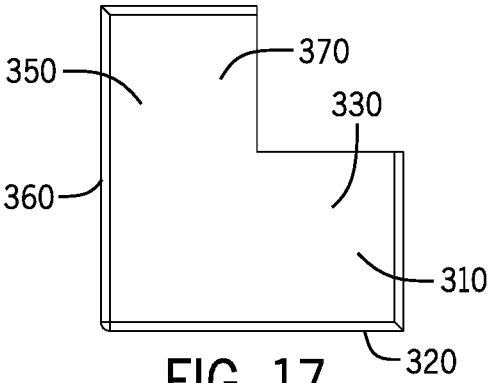
FIG. 17
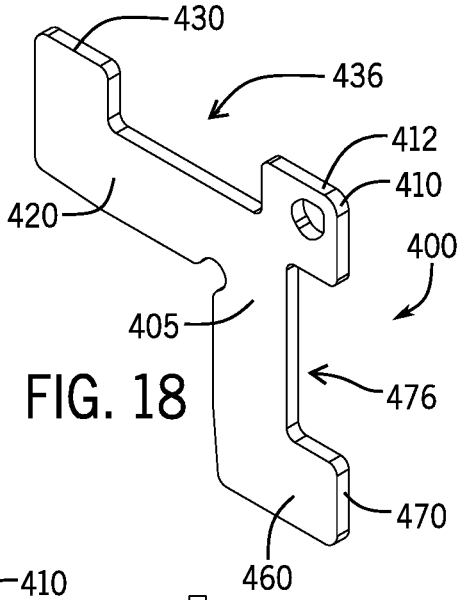
FIG. 18
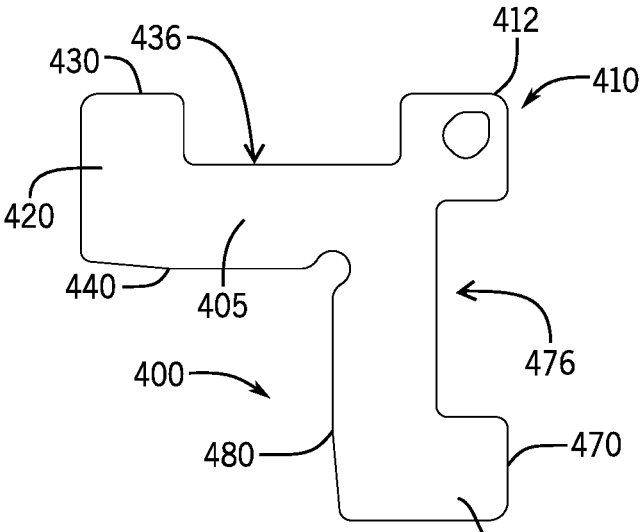
FIG. 19
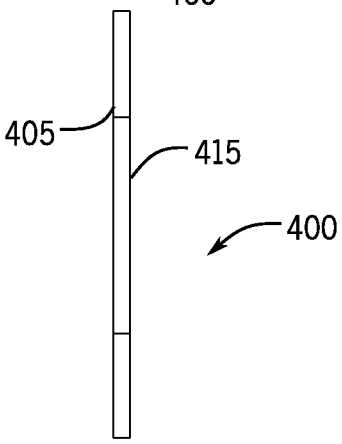
FIG. 20

FRAME WITH STRENGTHENED CORNERS

CROSS REFERENCE TO RELATED APPLICATION

This application claims the benefit of U.S. Provisional Patent Application 62/393,462 filed Sep. 12, 2016, which is hereby incorporated by reference.

FIELD OF INVENTION

The present invention relates to a frame with strengthened corners, which may be used to close cabinets.

BACKGROUND

Traditional frames are subject to racking, where the corners become misaligned. The traditional frames may be formed with mitered corners, which may be difficult to properly assemble. The mitered corners may be difficult to align.

SUMMARY

A frame assembly with strengthened corners is described.

In one aspect, the frame assembly includes internal corner sets that squeeze or pull mitered or angled edges of frame sections together. The corner sets fit into openings at corners between adjacent frame sections. The adjacent frame sections are fastened to the corner sets.

In another aspect, the frame assembly includes corner braces that snap lock over a corner between adjacent frame sections. The corner brace fits over exterior surfaces of the frame sections forming the frame assembly. The corner brace snaps into grooves in the exterior surfaces of the frame sections.

In another aspect, the frame assembly includes a corner member that engages to an outer flange of joining frame sections. The corner member spans the corner between the joining frame sections.

The internal corner sets, the corner braces, and the corner member may all be used together or individually to provide a frame assembly with strengthened corners.

In one aspect, the frame assembly covers a front of the cabinet and selectively opens and closes the cabinet. The frame assemblies may include sliding panels to cover the opening of the cabinet. The frame assemblies may further include a hinged door to cover the opening of the cabinet. The frame assemblies may further include a combination hinged door with sliding panels to cover the opening of the cabinet—commonly called a restocking closure. The frame assemblies described herein are well suited for use on emergency vehicles, such as ambulance, fire trucks, etc. The cabinets and frame may be used for storage on such vehicles. The frames with sliding panels and/or hinged doors may be used close the cabinets and prevent the contents of the cabinet from falling out of the cabinet.

Although the frame assemblies are described herein with respect to cabinets, the frame construction and components may be utilized in all types of frames and for all types of frames and framing applications.

The cabinets may further include a frame assembly with the restocking closure, which includes a hinged door with built-in sliding closures. This allows for the cabinet to be completely opened for restocking the cabinet, and also allows the cabinet to be accessed by sliding the closures, such as Plexiglas panels, to an open position for immediately retrieve items from the cabinet.

In one aspect, a frame assembly includes a first extruded frame section with a first mitered edge and a first channel. The frame assembly includes a second extruded frame section with a second mitered edge and a first channel. The first mitered edge and the second mitered edge are joined together to form a first corner of the frame assembly. A corner set includes a first side generally perpendicular to a second side. The first side of the corner set inserts into the first channel of the first extruded frame section and the second side inserts into the first channel of the second extruded frame section. The first side fixes to the first channel of the first frame section. The second side fixes to the first channel of the second frame section leaving a gap between a surface of the first channel and the second side of the corner set.

In another aspect, a frame assembly includes a first extruded frame section with a first mitered edge and a flange portion and a second extruded frame section with a second mitered edge and a flange portion. The first mitered edge and the second mitered edge are joined together to form a first corner of the frame assembly. A corner member includes a first side and a second side. The first side is generally perpendicular to the second side. The first side includes a first outer edge with a first cut-out. The second side includes a second outer edge with a second cut-out. The corner member spans over the joined first mitered edge and the second mitered edge. The corner member engages to the flange portion of the first and second extended frame sections.

In another aspect, a frame assembly includes a first extruded frame section with a first mitered edge and a second extruded frame section with a second mitered edge. The first mitered edge and the second mitered edge are joined together to form a first corner of the frame assembly. A corner brace strengthens the first corner of the frame assembly. The corner brace includes a first side generally perpendicular to a second side. The first side includes a first side wall generally perpendicular to a first rear wall. The second side includes a second side wall generally perpendicular to a second rear wall. The first side wall includes an inner surface, and the first rear wall includes an inner surface. The second side wall includes an inner surface, and the second rear wall includes an inner surface. The inner surfaces abut against outer surfaces of the frame sections.

BRIEF DESCRIPTION OF DRAWINGS

FIG. 10 is an end view of the frame section.

FIG. 11 is a perspective view of the corner brace.

FIG. 12 is a side view of the corner brace.

FIG. 13 is another side view of the corner brace.

FIG. 14 is a top view of the corner brace.

FIG. 15 is a perspective view of the corner set.

FIG. 16 is a bottom perspective view of the corner set.

FIG. 17 is a front view of the corner set.

FIG. 18 is a perspective view of the corner member.

FIG. 19 is a top view of the corner member.

FIG. 20 is a side view of the corner member.

DETAILED DESCRIPTION OF INVENTION

Figure 1:
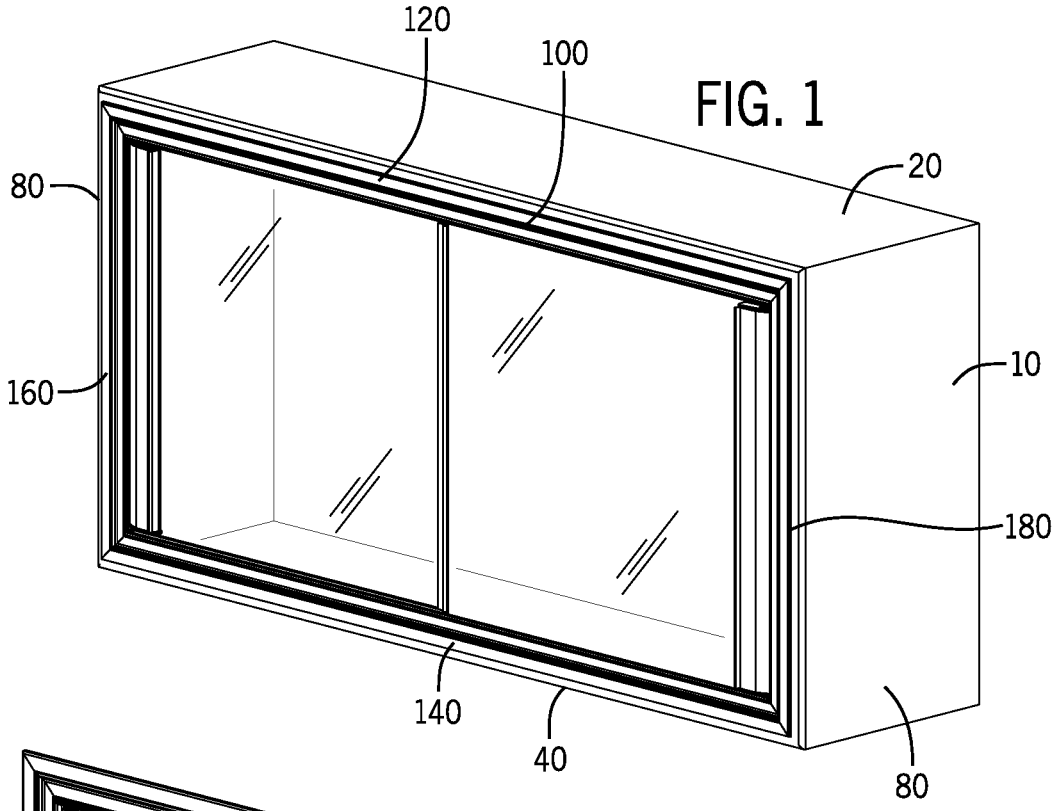
FIG. 1 is a perspective view of the cabinet and frame assembly.
Figure 2:
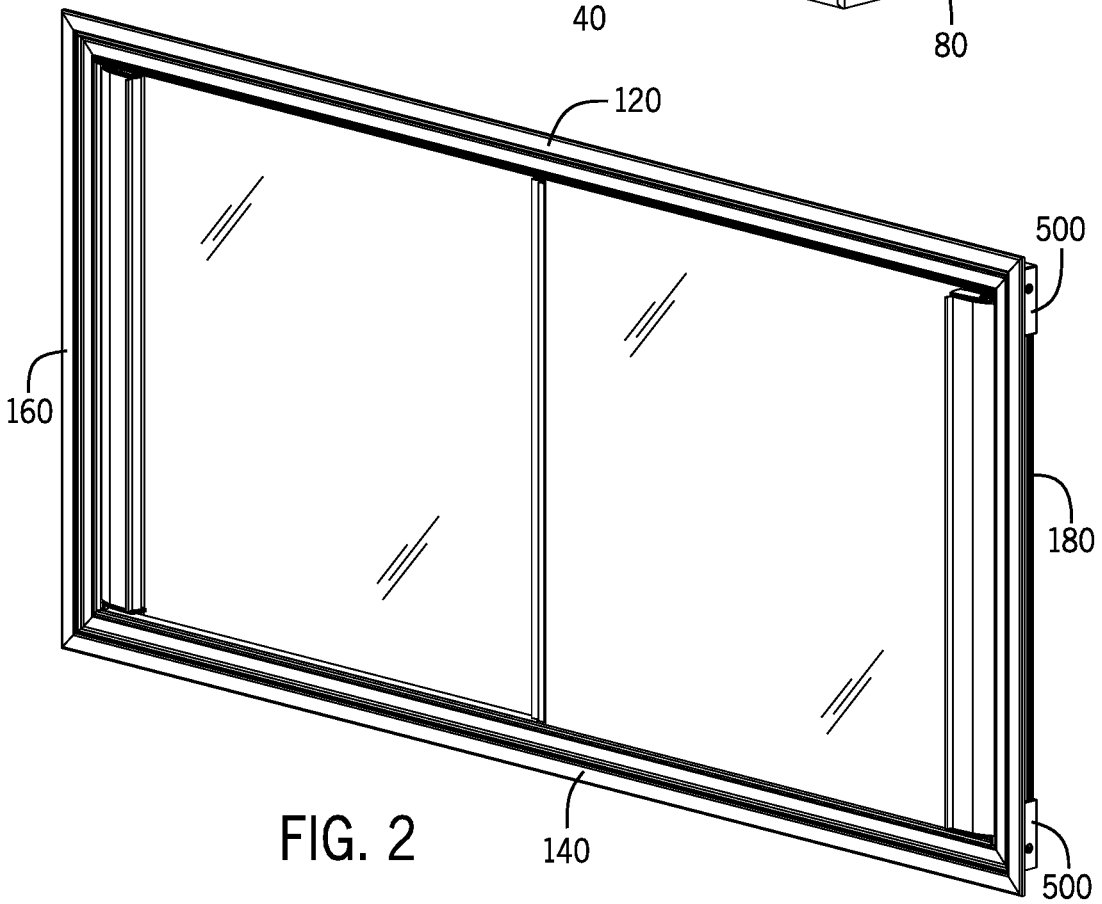
FIG. 2 is a perspective view of the frame assembly.
Figure 3:
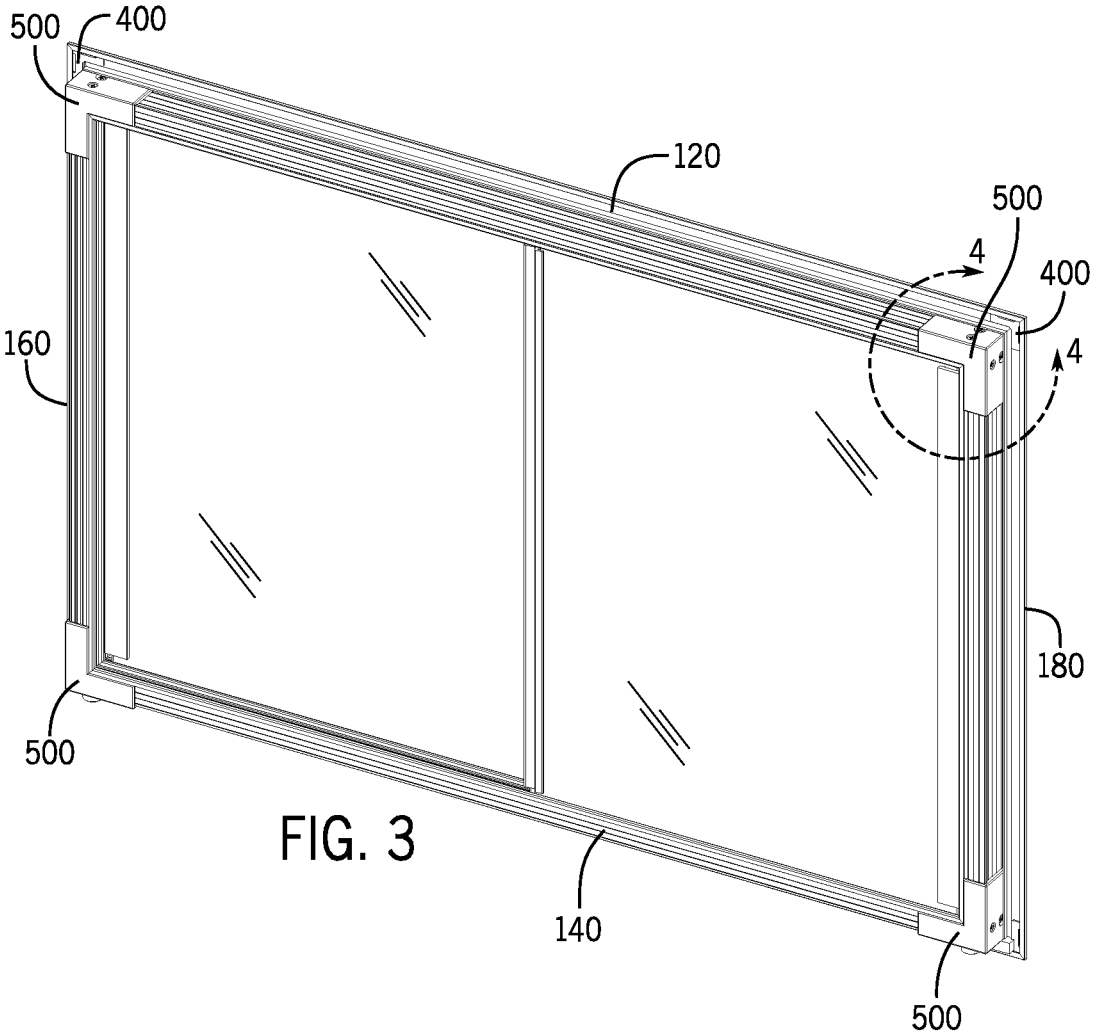
FIG. 3 is a rear perspective view of the frame assembly.
Figure 4:
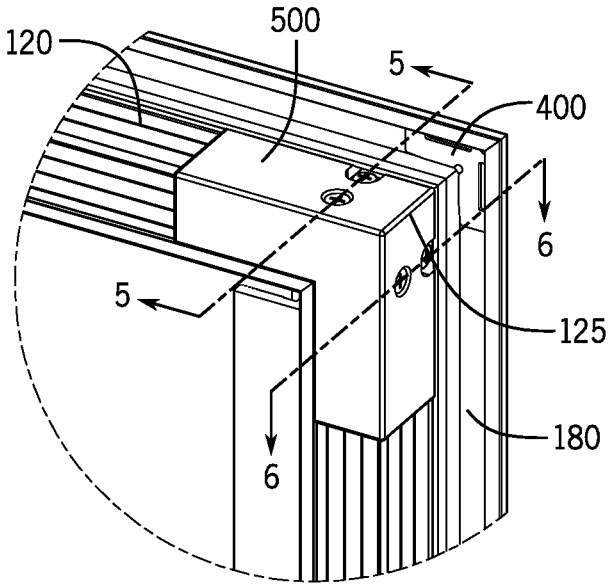
FIG. 4 is a close-up rear perspective view of one on the corners of the frame assembly.

With reference to FIGS. 1 and 2, a cabinet 10 and a frame assembly 100 are shown. The frame assembly 100 is attached to the cabinet 10. The frame assembly 100 may be installed over an opening of the cabinet 10.

The frame assembly 100 includes an upper frame section 120 opposite of a lower frame section 140 and a left frame section 160 opposite of a right frame section 180. The cabinet 10 may be formed to have a generally rectangular or square shape. The cabinet 10 includes an upper wall 20 opposite of a lower wall 40 and a left side wall 60 opposite of a right side wall 80. The walls 20, 40, 60, and 80 generally define the opening for the cabinet 10.

The sections 120, 140, 160, and 180 of the frame assembly 100 may be formed using extruded metal alloys. For example, aluminum may be melted and forced through a die resulting in lengths of an extrusion 200 having an end view as shown in FIG. 10. The sections 120, 140, 160, and 180 of the frame 100 may be cut to size from a length of the extrusion 200, as such, all of the frame sections 120, 140, 160, and 180 may have the same cross-section.

With reference to FIG. 10, the extrusion 200 includes a central wall 202. The extrusion 200 includes an outer wall 204, a center wall 206, and an inner wall 208, which all extend generally perpendicular to the central wall 202.

The extrusion 200 includes a first channel 210 with a first bottom surface 212. The extrusion 200 includes a second channel 220 with a second bottom surface 222. The first channel 210 and the second channel 220 are in a parallel arrangement. The first channel 210 and the second channel 220 may extend a length of the extrusion 200. The first channel 210 and the second channel 220 share the center wall 206 with a lateral side 206A of the center wall 206 forming one of the walls of the first channel 210 and another lateral side 206B of the center wall 206 forming one of the walls of the second channel 220. The inner wall 208 and the lateral side 206A define the first channel 210. The outer wall 204 and the lateral side 206B define the first channel 210.

The extrusion 200 includes a striker portion 230. The extrusion 200 includes a groove portion 240. The striker portion 230 and the groove portion 240 are at opposite ends of the central wall 202.

The extrusion 200 includes a flange portion 250. The flange portion 250 extends in a generally perpendicular direction to the central wall 202, but in an opposite direction of the outer wall 204, the center wall 206, and the inner wall 208. The flange portion 250 includes include an inner flange wall 251. The flange portion 250 includes a hook portion 255 defining a cavity 257. The flange portion 250 includes an inner flange surface 258. A notch 259 is opposite of the cavity 257. The extrusion 200 may be cut into the frame sections 120, 140, 160, and 180. A single length of the same piece of extrusion 200 may be cut into one or more of the frame sections 120, 140, 160, and 180.

With reference to FIGS. 15-17, a corner set 300 is shown. The corner set 300 squeezes or pulls mitered or angled edges of joining frame sections together. The corner set 300 inserts into ends of adjacent frame sections and the corner sets 300 are fastened to the ends of the adjacent frame sections. In the aspects shown, the edges of the joining frame sections are at an approximately 45 degree angle.

The corner set 300 includes a first side 310 generally perpendicular to a second side 350. A corner 315 separates the first side 310 and the second side 350. The first side 310 includes a first outer surface 320 with a first opening 322. The first side 310 includes a first lateral surface 330 and a second lateral surface 340. The second side 350 includes a second outer surface 360. The second side 350 includes a first lateral surface 370 and a second lateral surface 380. The first side 310 and the second side 350 of the corner set 300 may be asymmetrical to each other.

Figure 5:
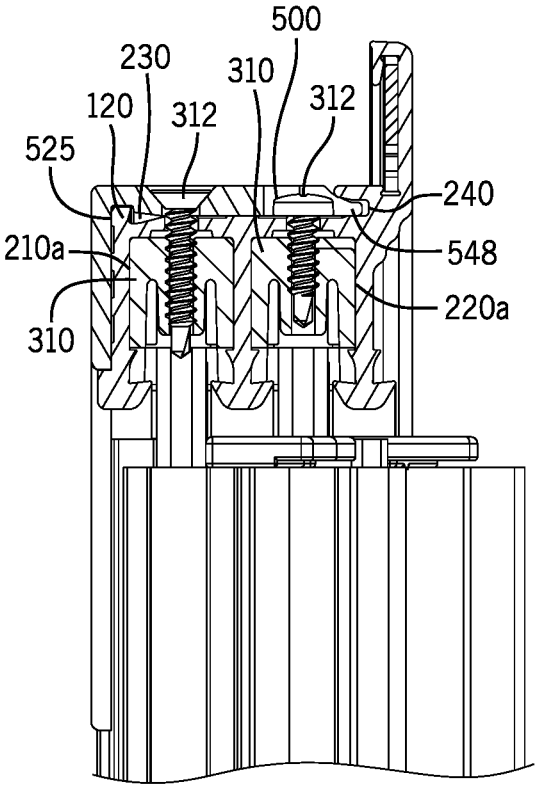
FIG. 5 is a sectional view of the fixed side of the corner.
Figure 6:
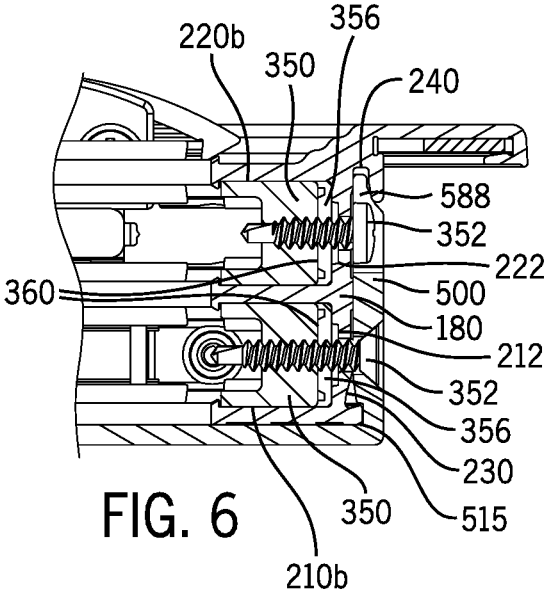
FIG. 6 is a sectional view of the floating side of the corner.
Figure 7:
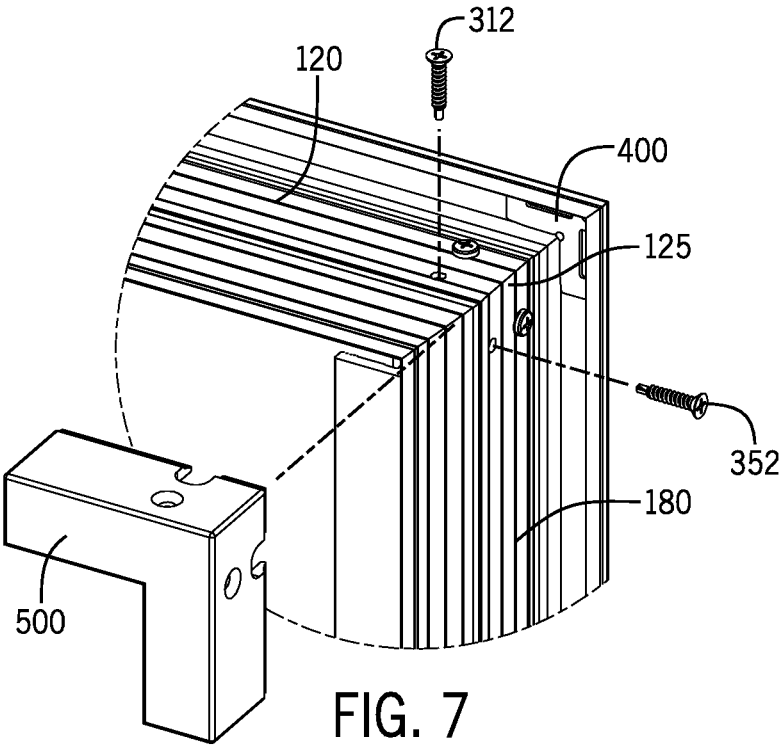
FIG. 7 is an exploded view of the corner brace prior to engaging the corner.
Figure 8:
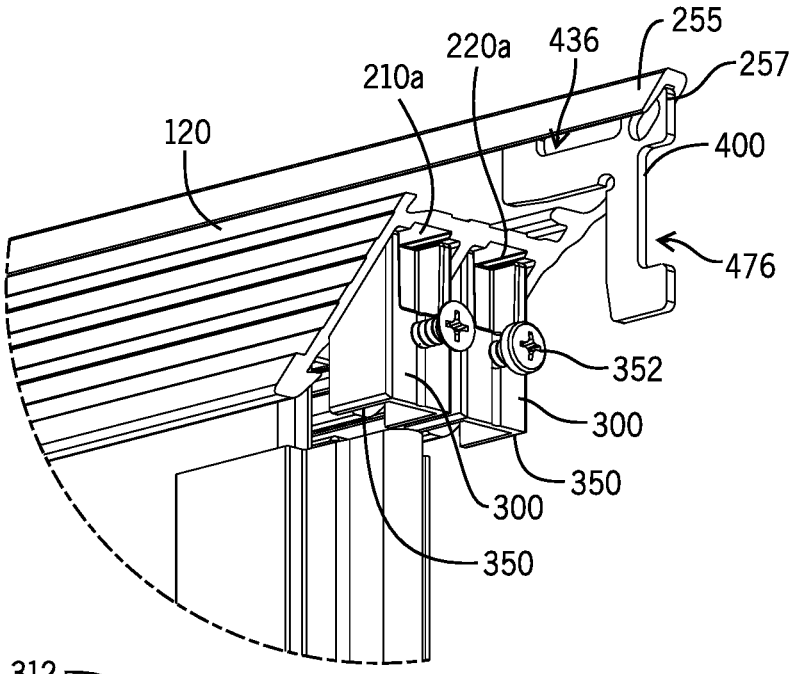
FIG. 8 is a sectional view showing one of the frame sections removed from the frame assembly
Figure 9:
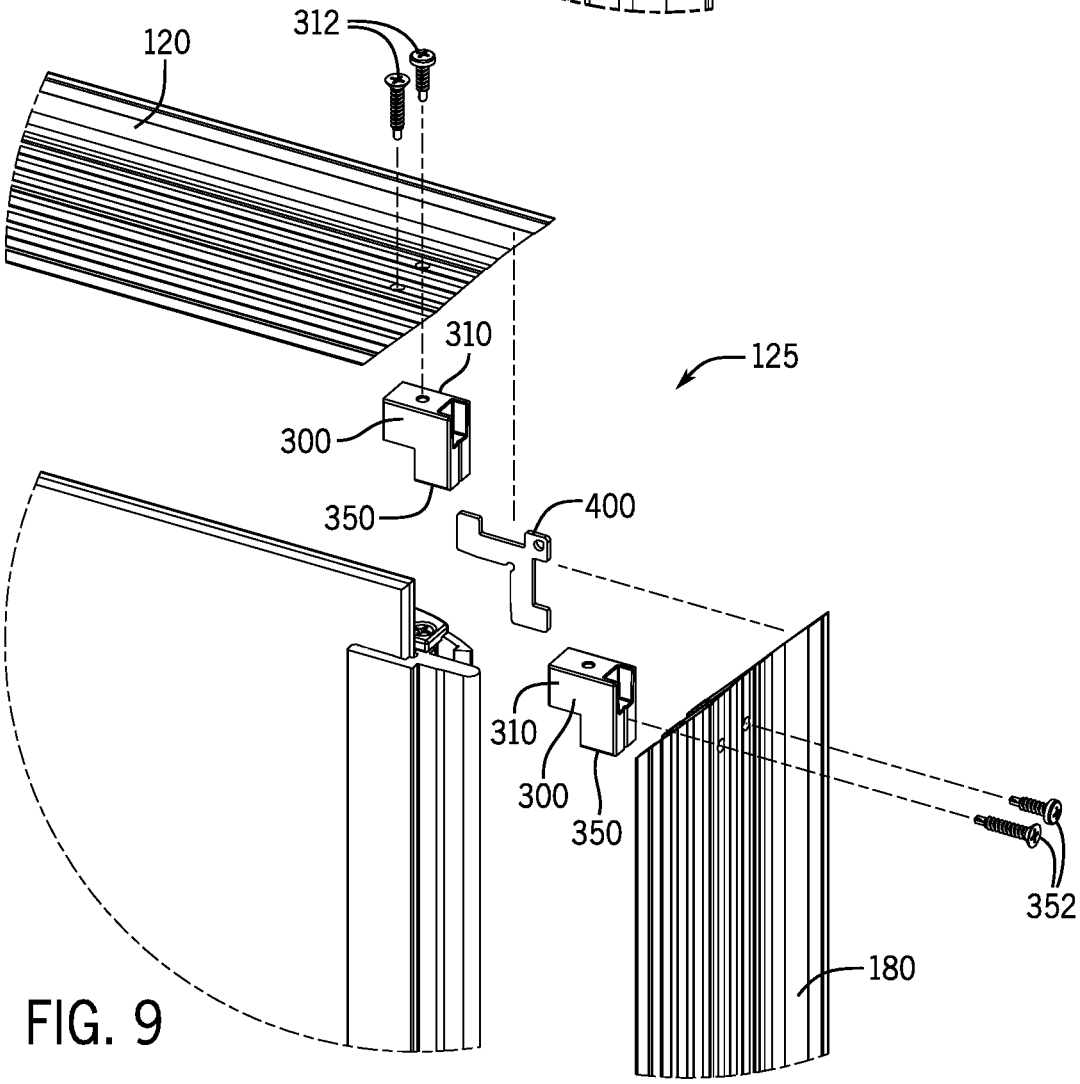
FIG. 9 is an exploded view of the corner.
Figure 21:
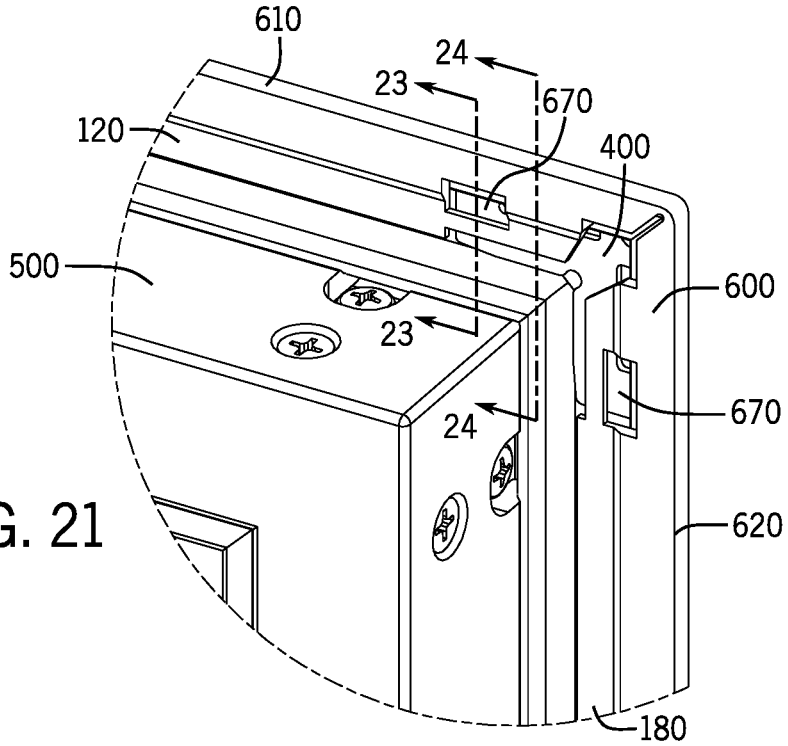
FIG. 21 is a perspective view of the gasket over the corner of the frame assembly.
Figure 22:
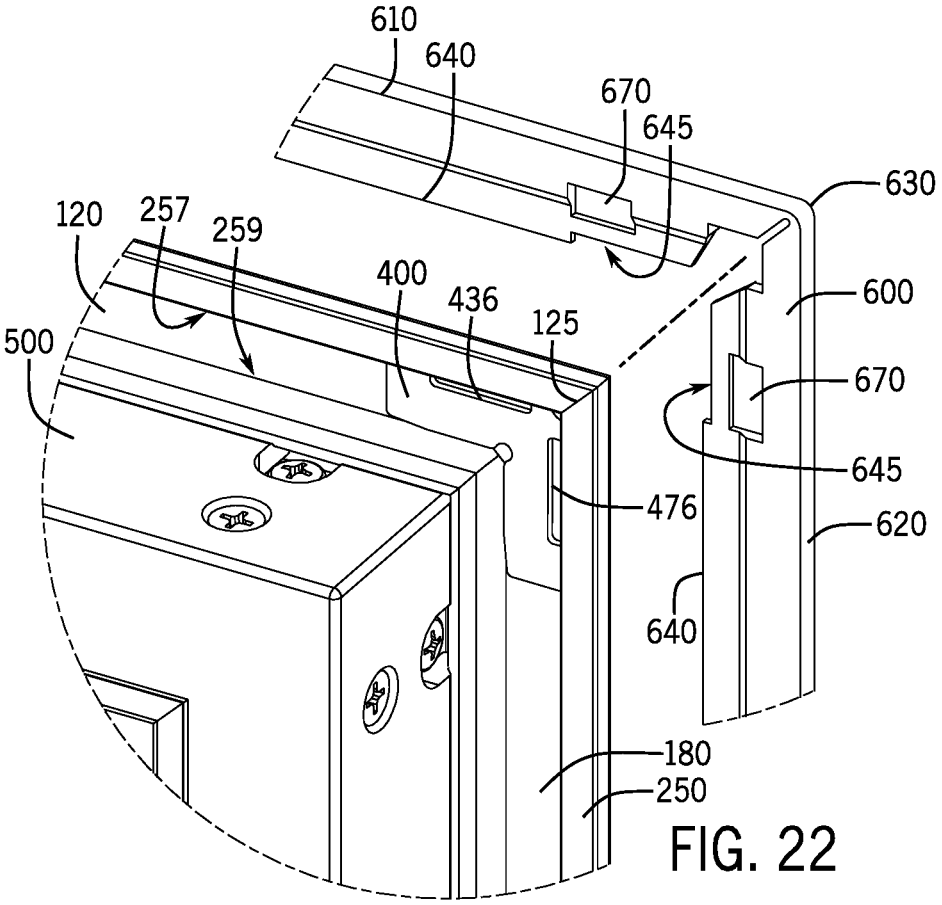
FIG. 22 is a perspective view of the gasket removed from the corner of the frame assembly.
Figure 23:
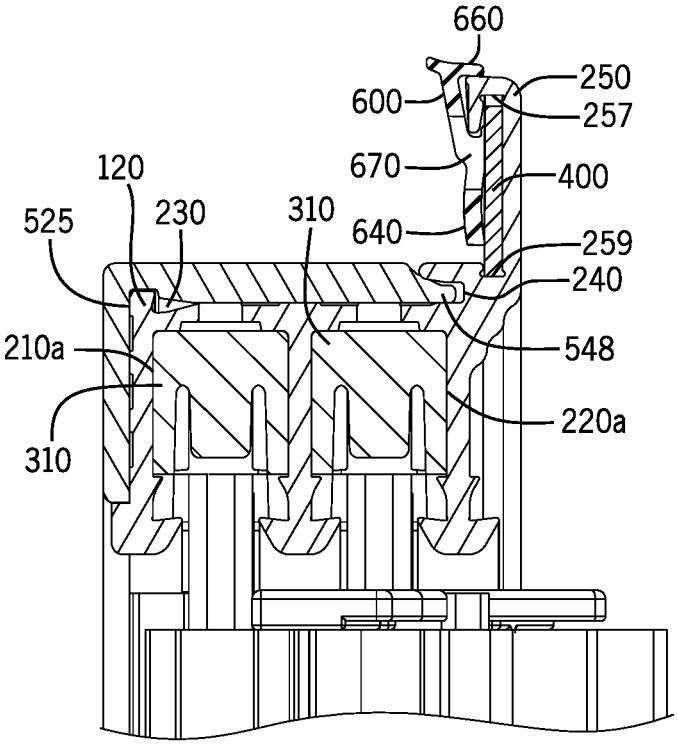
FIG. 23 is a sectional view of the gasket over the corner of the frame assembly.
Figure 24:
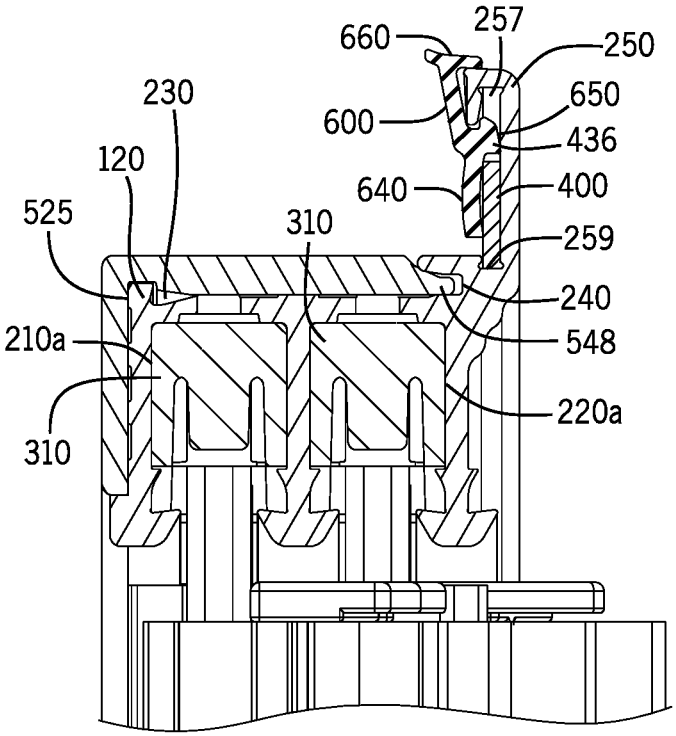
FIG. 24 is a sectional view of the gasket over the corner of the frame assembly.

The assembly of a corner 125 between the upper frame section 120 and the right frame section 180 is shown in FIGS. 5-9. During the assembly, the first side 310 of the corner set 300 is inserted into a channel opening of a first channel 210*a* of the upper frame section 120 and the second side 350 is inserted into a channel opening of a first channel 210*b* of the right frame section 180. The first side 310 of the corner set 300 is fixed to the first channel 210*a* of the frame 120 with screws 312. The second side 350 of the corner set 300 is fixed to the first channel 210*b* of the frame 180 with screws 352. The first side 310 of the corner set 300 is wider than the second side 350, i.e., the second side 350 is narrower than the first side 310. As shown in FIG. 6, the second side 350 becomes a "floating" side of the corner set 300, while the first side 310 is the "fixed" side of the corner set 300. The screw 352 passes through an opening in the frame 180 and into the outer surface 360 of the second side 350. A gap 356 exists between the channel surfaces 212, 222 (the bottom surfaces of the channels 210*b*, 220*b*) and the outer surfaces 360 of the second sides 350. The outer surface 360 of the second side 350 is not touching the channel surfaces 212, 222. As the second side 350 is further fastened to the first channel 210*b* by tightening the screw 352, the section 180 is drawn to the section 120 and the gap 356 is reduced in size. The mitered edge of the section 180 slides against the mitered edge of the section 120. The tightening of the screw 352 moves the sections 180 and the mitered edge of the section 180 moves against the mitered edge of the section 120. The screw 352 is tightened until the sections 120 and 180 are brought even with each other. This action pulls the corner 125 together between the sections 120 and 180 and provides a strengthened corner 125. This action aligns the mitered edges of the sections 120 and 180.

After installation of the cornet sets 300, the joint between the sections 120 and 180 is further strengthened with installation of a corner member 400. With reference to FIGS. 18-20, the corner member 400 is shown. The corner member 400 has a general shape of a right angle. The corner member 400 includes a first side 420 and a second side 460. The first side 420 is generally perpendicular to the second side 460. The first side 420 and the second side 460 may have a same or similar length. In other aspects, one of the first side 420 or the second side 460 may have a longer length than the other side. The corner member 400 includes an upper surface 405 and a lower surface 415. The corner member 400 includes a relatively thin thickness—i.e. less than approximately 1/16 of an inch, although the corner member 400 may be scaled to larger thickness for other applications.

The first side 420 includes a first outer edge 430 with a first cut-out 436. Opposite of the first outer edge 430, the corner member 400 includes a first inner edge 440. The second side 460 includes a second outer edge 470 with a second cut-out 476. Opposite of the second outer edge 470, the corner member 400 includes a second inner edge 480. As described below in greater detail, the cut-outs 436 and 476 provide for a gasket 600 to fit closely against the inner flange wall 251. In the aspect illustrated, the cut-outs 436 and 476 are generally rectangular openings in the first side 420 and the second side 460. The cut-outs 436 and 476 are formed in the respective outer edge 430 and 470. At the cut-outs 436 and 476, a width of the first side 420 and the second side 460 is reduced. The cut-outs 436 and 476 may extend, for example, approximately 1/4 to approximately/into the width of first side 420 and the second side 460.

The first outer edge 430 and the second outer edge 470 lead into a corner 410. The corner 410 may include a cut-out 412. During installation, the corner member 400 spans the joined mitered edges at the corner 125. The outer edges 430 and 470 are inserted into the cavity 257 of the hook portion 255 of the respective flange portions 250 of the joining frame sections. The inner edges 440 and 480 of the corner member 400 are inserted into the notch 259 of the respective flange portions 250. The second side 460 of the corner member 400 is generally flush against the inner flange wall 251. Material from the frames 120 and 180 may be crimped or forced into the cut-out 412 of the corner 410 of the corner member 400 to further fasten the corner member 400 to the frames 120 and 180.

The corner member 400 may be formed from steel or other metal alloys. The corner member 400 may also be molded from plastic materials with sufficient durability and biasing strength to support the frame sections.

With reference to FIGS. 11-14, a corner brace 500 is shown. The corner brace 500 may be cast from metal materials. The corner brace 500 include a first side 530 generally perpendicular to a second side 570. The first side 530 meets with the second side 570 at a corner 510. The first side 530 includes a first side wall 540 generally perpendicular to a first rear wall 550. The second side 570 includes a second side wall 580 generally perpendicular to a second rear wall 590. The first side wall 540 includes an opening 542 and a cut-out 544. The second side wall 580 includes an opening 582 and a cut-out 584. In other aspects, the corner brace 500 may be formed from plastic or composite materials.

The first side wall 540 includes an inner surface 546, while the rear wall 550 includes an inner surface 556. The second side wall 580 includes an inner surface 586, while the rear wall 590 includes an inner surface 596. The inner surfaces 546, 586 abut against outer surfaces of the frame sections.

A groove 515 is formed in the corner brace 500 between junctions of the first side wall 540 and the rear wall 550. A groove 525 is formed in the corner brace 500 between the junction of the second side wall 580 and the rear wall 590.

The first side wall 540 includes an edge 548, and the second side wall includes an edge 588. As shown in FIGS. 5 and 6, the edges 548 and 588 insert into the groove portion 240 of the extrusion 200, while the striker portion 230 of the extrusion 200 inserts into the grooves 515 and 525 of the corner brace 500. This interaction snap-locks the corner brace 500 to the frame sections 120 and 180 and further strengthens the corner 125 between the frame sections 120 and 180.

In some aspects, the gasket 600 may cover the flange portion 250 of the frame sections 120, 140, 160, and 180. The gasket 600 may cover the corner 125 between respective frame sections 120, 140, 160, and 180. For example, a single piece of the gasket 600 may cover the corner 125 between frame sections 120 and 180 as well as portions of the frame sections 120 and 180.

With reference to FIGS. 21-24, the gasket 600 is shown. The gasket 600 may have a general shape of a right angle. The gasket 600 includes a first side 610 generally perpendicular to a second side 620. The first side 610 and the second side 620 generally meet at a corner 630.

The gasket 600 includes a profile to snap-fit or lock to the structures of the flange portion 250 of the frame sections 120, 140, 160, and 180. An inner edge 640 of the gasket 600 inserts into the notch 259 of the flange portion 250. A hook portion 650 of the gasket 600 inserts into the cavity 257 of the hook portion 255 of the flange portion 250. An outer edge 660 of the gasket 600 wraps around a lower edge 261 of the flange portion 250.

The gasket 600 may overlap the corner member 400 at the corner 125 between the frame sections 120 and 180. The gasket 600 and the corner member 400 both fit into the same notch 259 of the flange portion 250 and into the same cavity 257 of the hook portion 255 of the flange portion 250. In order for the gasket 600 and the corner member 400 to use the same structures for attachment, both the gasket 600 and the corner member 400 are modified proximate their respective corners 630 and 410. With respect to the gasket 600, a portion 645 of the inner edge 640 proximate the corner 630 is removed. Thus, narrowing a width of the gasket 600 in this region. Also, a portion of the hook portion 650 of the gasket 600 proximate the corner 630 is removed, for example, thus forming an opening 670 in the hook portion 650 of the gasket 600. This forms a gap in the hook portion 650. As described above, the corner member 400 includes the cut-outs 436 and 476. During installation of the gasket 600 to the frame sections 120 and 180, the hook portion 650 immediately adjacent to the corner 630 passes through the cut-outs 436 or 476 of the corner member 400 in order to insert into the cavity 257 of the flange portion 250. Since this region of the corner member 400 has the cut-outs 436 or 476, the outer edges 430 and 470 of the corner member 400 are not already in the cavity 257. Similarly, the opening 670 in the gasket 600 overlaps the outer edges 430 and 470 not having the cut-outs 436 or 476, since these portions of the outer edges 430 and 470 will already be in the cavity 257. Similarly, the portion 645 of the inner edge 640 that is removed is over the inner edges 440 and 480 of the corner member that are already inserted into the notch 259 of the flange portions 250. Thus, the remaining inner edge 640 fits into the notch 259 that does receive the inner edges 440 and 480 of the corner member 400.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A frame assembly, comprising:

a first extruded frame section with a first mitered edge and a first channel;

a second extruded frame section with a second mitered edge and a first channel;

the first mitered edge and the second mitered edge joined together to form a first corner of the frame assembly;

a corner set comprising a first side generally perpendicular to a second side;

the first side of the corner set inserts into the first channel of the first extruded frame section and the second side inserts into the first channel of the second extruded frame section;

the first side rigidly fixes to an inner surface of the first channel of the first frame section;

the second side fixes to the first channel of the second frame section leaving a gap between an inner surface of the first channel and the second side of the corner set; and, wherein a tightening of the second side of the corner set to the second frame section with a fastener moves the second frame section with respect to the first frame section and moves the second mitered edge against the first mitered edge at the first corner.

2. The frame assembly according to claim 1, wherein the first side of the corner set is fixed, and the second side of the corner set is floating.

3. The frame assembly according to claim 1, wherein the tightening of the second side of the corner set aligns the first frame section and the second frame section and pulls the first corner together.

4. The frame assembly according to claim 1, wherein the tightening of the second side of the corner set to the second frame section with the fastener moves the second frame section with respect to the first frame section and slides the first mitered edge against the second mitered edge to align the first mitered edge and the second mitered edge.

5. The frame assembly according to claim 1, wherein the second side is narrower in width than the first side.

6. The frame assembly according to claim 1, wherein the first side and the second side of the corner set are asymmetrical to one another.

7. The frame assembly according to claim 1, wherein the tightening of the second side of the corner set aligns the first frame section and the second frame section and reduces a size of the gap.

8. The frame assembly according to claim 1, wherein the tightening of the second side of the corner set draws a bottom surface of the first channel of the second extruded frame section to an outer surface of the second side of the corner set.

9. The frame assembly according to claim 1, wherein the corner set is not touching a bottom surface of the first channel of the second extruded frame section.

10. The frame assembly according to claim 1, wherein the frame assembly is a part of a cabinet configured for an emergency vehicle.

11. A frame assembly, comprising:

a first extruded frame section with a first mitered edge and a flange portion;

a second extruded frame section with a second mitered edge and a flange portion;

the first mitered edge and the second mitered edge joined together by a corner set to form a first corner of the frame assembly, the corner set comprising a first side generally perpendicular to a second side; the first side of the corner set inserts into a first channel of the first extruded frame section and the second side inserts into a first channel of the second extruded frame section; the first side fixes to the first channel of the first frame section; the second side fixes to the first channel of the second frame section;

a corner member, comprising:

a first side and a second side, the first side is generally perpendicular to the second side;

the first side integral with the second side in the shape of a right angle;

the first side of the corner member includes a first outer edge with a first cut-out;

the second side of the corner member includes a second outer edge with a second cut-out;

the corner member spans over the joined first mitered edge and the second mitered edge; and, the corner member engages to the flange portions of the first and second extruded frame sections, and wherein the first and second outer edges of the corner member are inserted into cavities of the flange portions of the first and second extruded frame sections.

12. The frame assembly according to claim 11, wherein the first cut-out is formed in the first outer edge and the first cut-out extends into a width of the first side, and wherein the second cut-out is formed in the second outer edge and the second cut-out extends into a width of the second side.

13. The frame assembly according to claim 11, wherein the corner member comprises a first inner edge opposite of the first outer edge, wherein the corner member comprises a second inner edge opposite of the second outer edge, and wherein the first and second inner edges are inserted to into a notch of the flange portions of the first and second extruded frame sections.

14. The frame assembly according to claim 11, wherein a gasket member overlaps the corner member and engages to the flange portion of the first and second extended frame sections.

15. The frame assembly according to claim 11, wherein a gasket member includes and an inner edge and a hook portion, the inner edge of the gasket inserts into a notch of the flange portion, and the hook portion of the gasket inserts into a cavity of the flange portion.

16. The frame assembly according to claim 11, wherein a gasket member overlaps the corner member and engages to the flange portion of the first and second extended frame sections, wherein the gasket includes an opening positioned over the first outer edge or the second outer edge.

17. The frame assembly according to claim 11, wherein the corner member includes a thickness of less than approximately 1/16 of an inch.

18. A frame assembly, comprising:

a first extruded frame section with a first mitered edge;

a second extruded frame section with a second mitered edge;

the first mitered edge and the second mitered edge joined together to form a first corner of the frame assembly;

a corner brace to strengthen the first corner of the frame assembly, wherein the corner brace fits over the first corner of the frame assembly, wherein the corner brace snap-fits over outer surfaces of the first and second extruded frame sections;

the corner brace includes a first side generally perpendicular and integral to a second side;

the first side includes a first side wall generally perpendicular to a first rear wall;

the second side includes a second side wall generally perpendicular to a second rear wall;

the first side wall includes an inner surface, and the first rear wall includes an inner surface;

the second side wall includes an inner surface, and the second rear wall includes an inner surface;

the inner surfaces abut against the outer surfaces of the frame sections;

wherein the first side wall includes a first edge, and the second side wall includes a second edge, and the first and second edges insert into groove portions of the frame sections; and, wherein a first groove is formed in the corner brace between a junction of the first side wall and the first rear wall, a second groove is formed in the corner brace between a junction of the second side wall and the second rear wall, and wherein striker portions of the frame sections insert into the first and second grooves of the corner brace.

19. The frame assembly according to claim 18, wherein the groove portions and the striker portions of the frame sections are formed on central walls forming the frame sections.

20. The frame assembly according to claim 19, wherein the groove portions and the striker portions of the frame section are on opposite sides of the central walls forming the frame sections.

21. A frame assembly, comprising:

a first extruded frame section with a first mitered edge and a first channel;

a second extruded frame section with a second mitered edge and a first channel;

the first mitered edge and the second mitered edge joined together by a corner set to form a first corner of the frame assembly;

the corner set comprising a first side generally perpendicular to a second side;

the first side of the corner set inserts into the first channel of the first extruded frame section and the second side inserts into the first channel of the second extruded frame section;

the first side fixes to the first channel of the first frame section;

the second side fixes to the first channel of the second frame section;

wherein a tightening of the second side of the corner set to the second extruded frame section with a fastener pulls the second mitered edge against the first mitered edge at the first corner;

a corner brace to strengthen the first corner of the frame assembly;

the corner brace includes a first side generally perpendicular to a second side;

the first side includes a first side wall generally perpendicular to a first rear wall;

the second side includes a second side wall generally perpendicular to a second rear wall;

the first side wall includes an inner surface, and the first rear wall includes an inner surface;

the second side wall includes an inner surface, and the second rear wall includes an inner surface; and, the corner brace fits over exterior surfaces of the first and second extruded frame sections and the inner surfaces of the corner brace abut against outer surfaces of the first and second extruded frame sections.

* * * * *